US011300282B1

(12) United States Patent
Lincoln et al.

(10) Patent No.: US 11,300,282 B1
(45) Date of Patent: Apr. 12, 2022

(54) LIGHTING FIXTURES WITH ENHANCED HEAT SINK PERFORMANCE

(71) Applicant: Lumecon, Farmington Hills, MI (US)

(72) Inventors: Donald R. Lincoln, Brighton, MI (US); Lisandro R. Gutierrez, Garden City, MI (US)

(73) Assignee: Lumecon, Farmington Hills, MI (US)

( * ) Notice: Subject to any disclaimer, the term of this patent is extended or adjusted under 35 U.S.C. 154(b) by 0 days.

(21) Appl. No.: 16/953,705

(22) Filed: Nov. 20, 2020

(51) Int. Cl.
*F21V 29/70* (2015.01)
*F21V 3/04* (2018.01)
*F21Y 115/10* (2016.01)

(52) U.S. Cl.
CPC ..... *F21V 29/70* (2015.01); *F21V 3/04* (2013.01); *F21Y 2115/10* (2016.08)

(58) Field of Classification Search
CPC ..... F21V 29/70; F21S 8/032
See application file for complete search history.

(56) References Cited

U.S. PATENT DOCUMENTS 8,128,262 B2 * 3/2012 Ramer ..... F21V 5/10 362/327
2010/0134016 A1 * 6/2010 York ..... F21V 29/767 315/113
2011/0006658 A1 * 1/2011 Chan ..... F21K 9/233 313/45
2012/0007486 A1 * 1/2012 Mora ..... F21V 29/89 313/46
2014/0071678 A1 * 3/2014 Chen ..... F21K 9/232 362/249.02
2014/0078723 A1 * 3/2014 Chen ..... F21V 29/71 362/184
2020/0096704 A1 * 3/2020 Wilcox ..... G02B 6/32
2020/0363580 A1 * 11/2020 Li ..... G02B 6/0085

* cited by examiner

*Primary Examiner* — Alexander K Garlen
*Assistant Examiner* — Eric T Eide
(74) *Attorney, Agent, or Firm* — Vivacqua Crane PLLC

(57) ABSTRACT

A lighting fixture with enhanced heat sink performance is provided. The fixture comprises an upper globe portion and a lower globe portion formed of a substantially transparent light transmitting material for emitting light. The fixture comprises a unitary ring heat sink member including an outside surface and an inside surface. The inside surface includes a plurality of mating surface portions having a flat mating face configured for mating engagement with a respective light source board and for selectively positioning of the light source boards. The heat sink member comprises a first material having a volume V defined by:
$V=(Q*(\lambda*2))/\Delta T$, wherein Q is a heat source power, $\lambda$ is a thermal conductivity of the first material, and $\Delta T$ is a difference in temperature between a maximum thermal threshold temperature for a light-emitting diode and a maximum ambient temperature.

20 Claims, 4 Drawing Sheets

LIGHTING FIXTURES WITH ENHANCED HEAT SINK PERFORMANCE

CROSS-REFERENCE TO RELATED APPLICATIONS

This application claims the benefit of U.S. Provisional Application No. 62/938,033, filed on Nov. 20, 2019 entitled "LIGHTING FIXTURES WITH ENHANCED HEAT SINK PERFORMANCE" which is incorporated herein by reference in its entirety.

INTRODUCTION

The present invention relates generally to lighting fixtures and luminaires, and more particularly, relates to a lighting fixture having enhanced heat sink performance with a heat sink member connecting upper and lower portions of an outdoor lighting globe.

Today many companies are offering decorative outdoor light emitting diode (LED) retrofit kits and new LED fixtures in order to take advantage of the long life, excellent color and beam control and other benefits of LEDs. LEDs are temperature sensitive and generate a significant amount of heat, which is to be removed from the fixture in order to assure long life and adequate illumination.

SUMMARY

A need exists for a new lighting fixture that employs a heat sink and light distribution which preserves and enhances the aesthetic design of the luminous globe while optimizing heat extraction and providing a configuration for maximizing optical performance.

A principal aspect of the present invention is to provide a lighting fixture having an enhanced heat sink performance. Other important aspects of the present invention are to provide such lighting fixture substantially without negative effect and that overcome many of the disadvantages of prior art arrangements.

In one aspect of the present disclosure, a lighting fixture with enhanced heat sink performance is provided. The fixture comprises an upper globe portion and a lower globe portion formed of a substantially transparent light transmitting material for emitting light. The fixture comprises a unitary ring heat sink member including an outside surface and an inside surface. The inside surface includes a plurality of mating surface portions having a flat mating face configured for mating engagement with a respective light source board and for selectively positioning of the light source boards. The heat sink member comprises a first material having a volume V defined by: $V=(Q*(\lambda*2))/\Delta T$, wherein Q is a heat source power, $\lambda$ is a thermal conductivity of the first material, and $\Delta T$ is a difference in temperature between a maximum thermal threshold temperature for a light-emitting diode and a maximum ambient temperature.

In one embodiment of this aspect, the first material comprises one of aluminum, aluminum alloy, iron, and iron alloy. Moreover, the plurality of mating surface portions is between 7 and 12 mating surface portions. Further, the light-emitting diode is disposed on the light source board.

In another embodiment, each flat mating face is formed canted downwardly at an angle between about 15 degrees and about 30 degrees. Moreover, each flat mating face is formed canted downwardly at an angle of about 22 degrees. Furthermore, the one of the upper globe and the lower globe comprises a translucent material able to transmit more than about 5% of incident electromagnetic waves in visible range.

In accordance with features of the invention, the heat sink member is formed of a thermally conductive material, such as 10 aluminum.

Each of the light source boards includes a predefined number of light emitting diodes (LEDs). The light source board includes a metal core circuit board.

In accordance with features of the invention, mating surface portions are configured for mating engagement with a respective light source boards that are canted at an angle to direct a LED light output proximate to a point on a light center of the fixture.

In accordance with features of the invention, a polygon shaped lighting fixture provides a LED light output to cross in a plane proximate to a light center of the fixture.

In another aspect, another lighting fixture with enhanced heat sink performance is provided. The lighting fixture comprises an upper globe portion and a lower globe portion formed of a substantially transparent light transmitting material for emitting light. The lighting fixture comprises a unitary ring heat sink member comprising an outside surface and an inside surface. The outside surface is disposed exterior of the lighting fixture. The inside surface is disposed inside of the lighting fixture. The inside surface includes a plurality of mating surface portions having a flat mating face configured for mating engagement with a respective light source board and for selectively positioning of the light source boards. The heat sink member joins the upper globe portion and the lower globe portion of the lighting fixture. The heat sink member comprises a first material having a volume V defined by: $V=(Q*(\lambda*2))/\Delta T$, wherein Q is a heat source power, $\lambda$ is a thermal conductivity of the first material, and $\Delta T$ is a difference in temperature between a maximum thermal threshold temperature for a light-emitting diode and a maximum ambient temperature.

In one embodiment of this aspect, the first material comprises one of aluminum, aluminum alloy, iron, and iron alloy. Moreover, the plurality of mating surface portions is between 7 and 12 mating surface portions. Further, the light-emitting diode is disposed on the light source board.

In another embodiment, each flat mating face is formed canted downwardly at an angle between about 15 degrees and about 30 degrees. Moreover, in another embodiment, each flat mating face is formed canted downwardly at an angle of about 22 degrees. Further, the one of the upper globe and the lower globe comprises a translucent material able to transmit more than about 5% of incident electromagnetic waves in visible range.

In yet another aspect of the present disclosure, a lighting fixture is provided. The lighting fixture comprises an upper globe portion and a lower globe portion formed of a substantially transparent light transmitting material for emitting light. The lighting fixture further comprises a unitary ring heat sink member including an outside surface and an inside surface. The inside surface includes a plurality of mating surface portions having a flat mating face configured for mating engagement with a respective light source board and for selectively positioning of the light source boards. The heat sink member comprises a first material having a volume V defined by:

$$V=(Q*(\lambda*2))/\Delta T,$$

wherein Q is a heat source power, $\lambda$ is a thermal conductivity of the first material, and $\Delta T$ is a difference in temperature between a maximum thermal threshold temperature for a light-emitting diode and a maximum ambient temperature. Moreover, each flat mating face is formed canted downwardly at an angle between about 15 degrees and about 30 degrees.

In one embodiment of this aspect, the first material comprises one of aluminum, aluminum alloy, iron, and iron alloy. Moreover, the plurality of mating surface portions is between 7 and 12 mating surface portions. Further, the light-emitting diode is disposed on the light source board.

In another embodiment, each flat mating face is formed canted downwardly at an angle of about 22 degrees. Moreover, the one of the upper globe and the lower globe comprises a translucent material able to transmit more than about 5% of incident electromagnetic waves in visible range.

In accordance with features of the invention, a plurality of mounting clips are provided with the heat sink member to connect the upper and lower globe portions of the lighting fixture.

DETAILED DESCRIPTION

Figure 1:
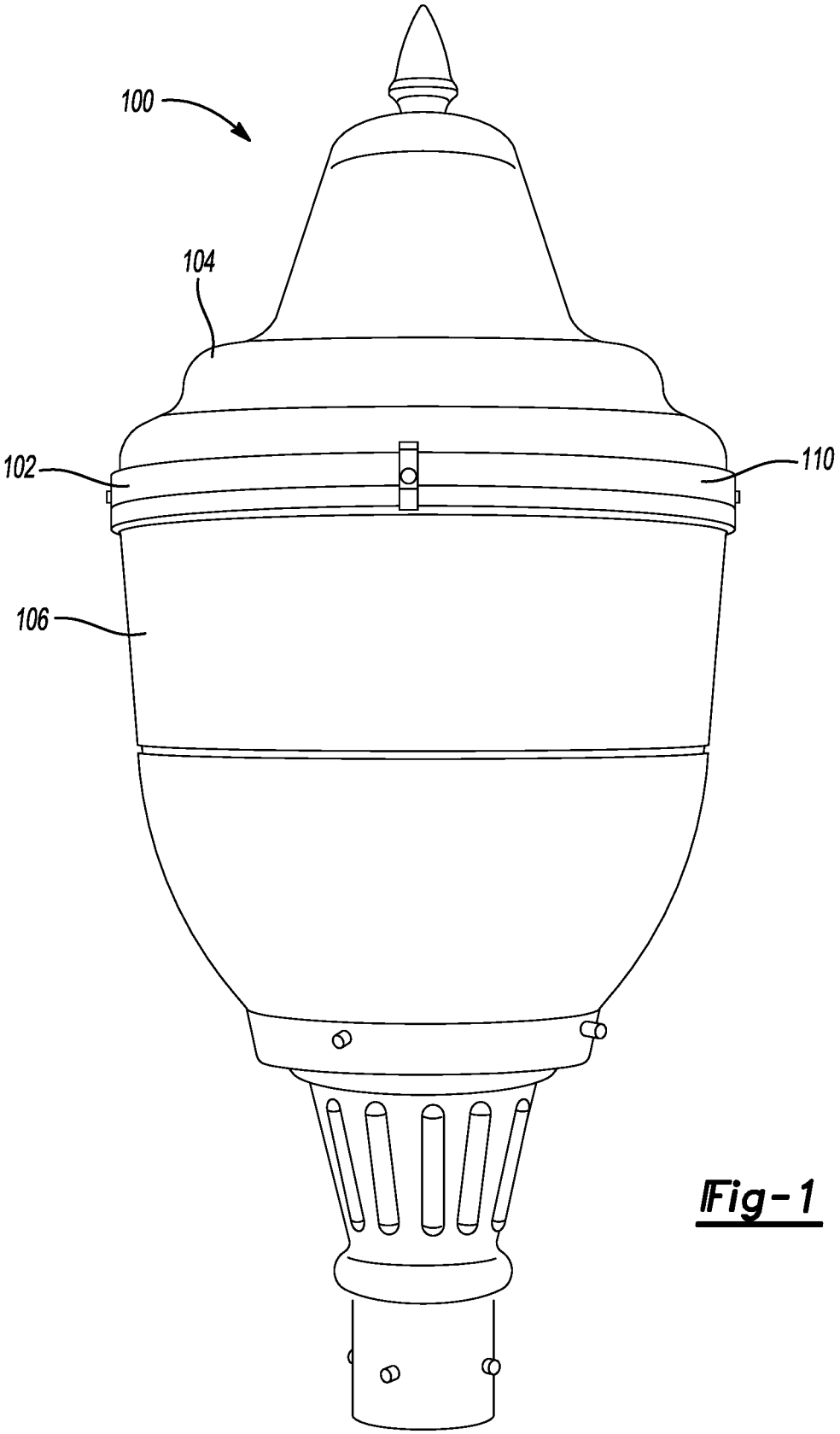
FIG. 1 is a side view of a light fixture in accordance with one embodiment of the present disclosure.
Figure 2:
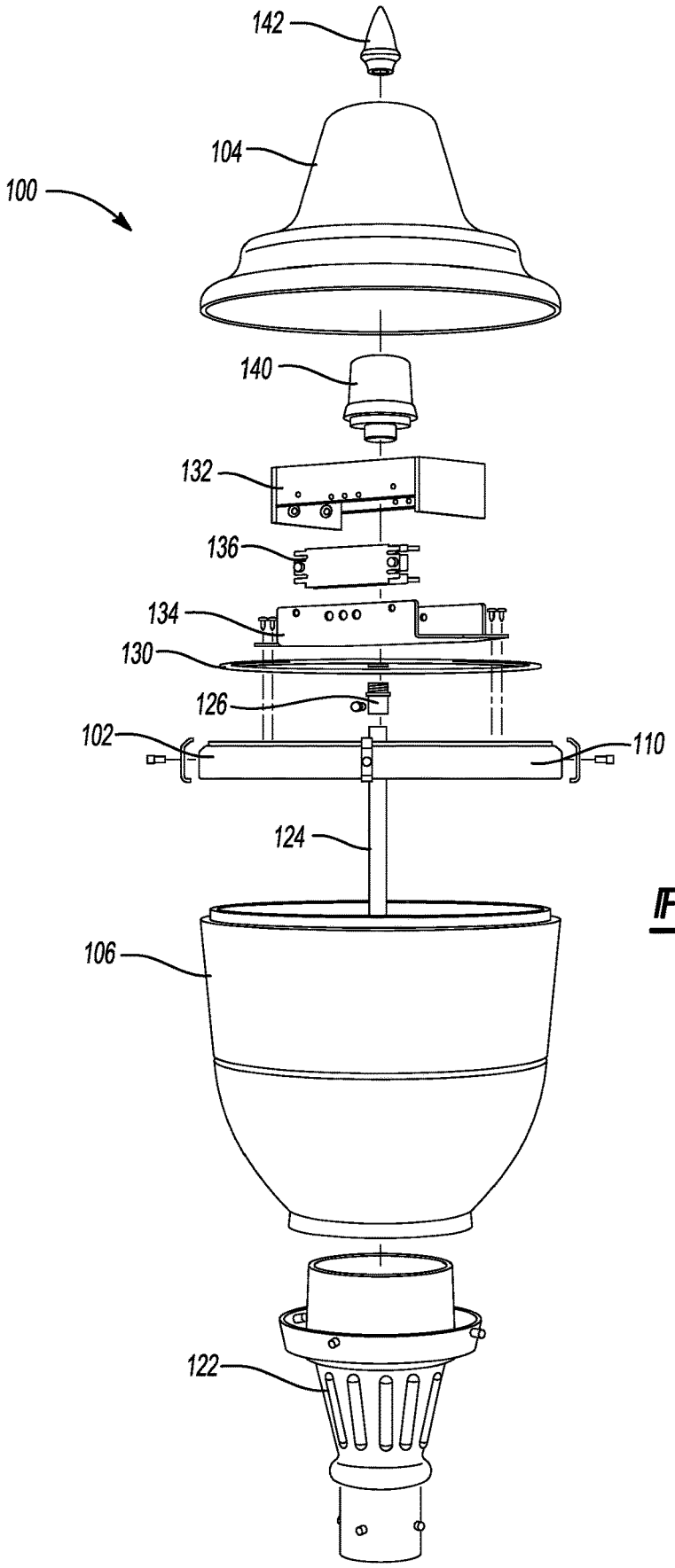
FIG. 2 is an exploded view of the light fixture in FIG. 1.
Figure 3A:
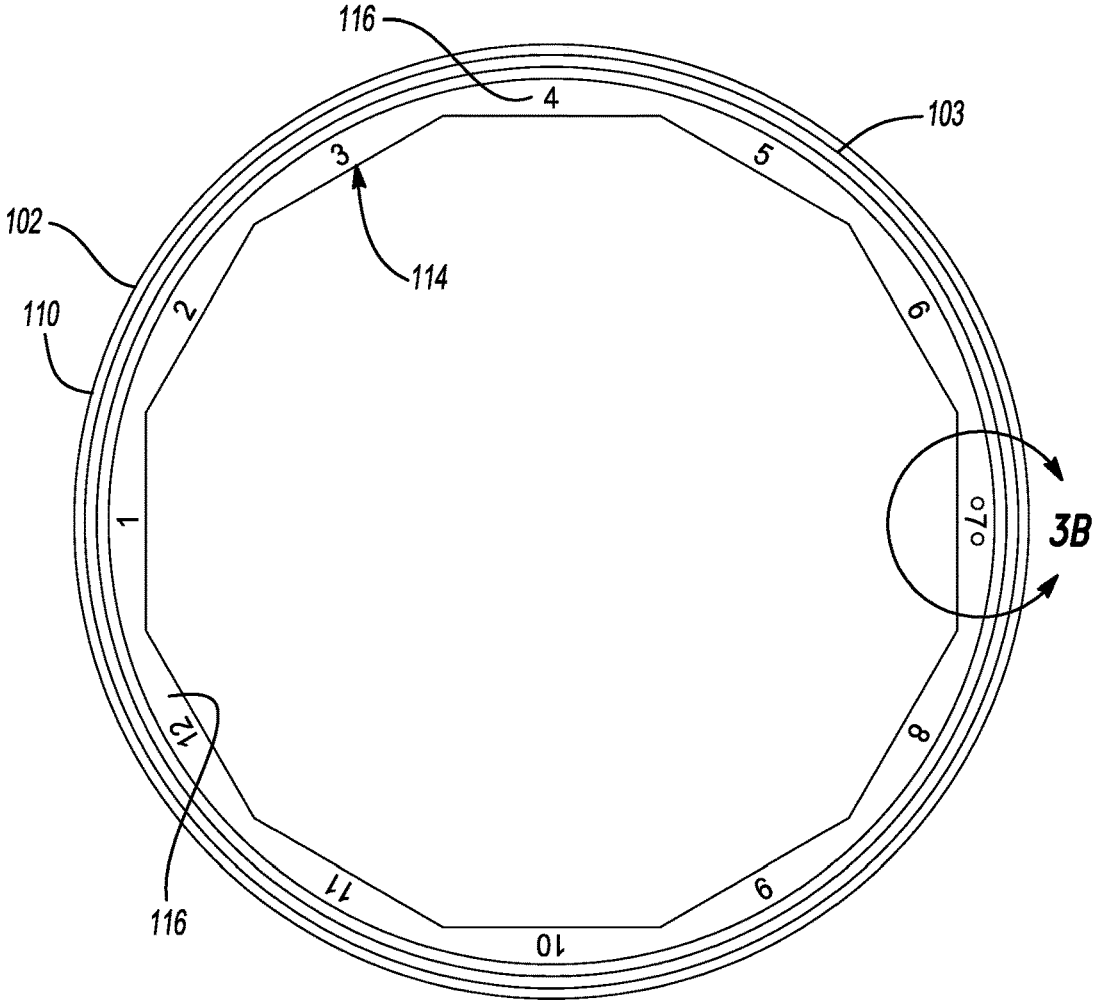
FIG. 3A is a plan view of a unitary ring heat sink member of the light fixture in FIG. 1 according to one embodiment.

Having reference now to the drawings, in FIGS. 1-3A, there is shown a lighting fixture generally designated by the reference character 100 in accordance with the preferred embodiment. Lighting fixture 100 includes a finless heat sink member generally designated by the reference character 102 in accordance with the preferred embodiment. Lighting fixture 100 includes an upper globe portion 104 and a lower globe portion 106, for example, of an outdoor lighting globe 100. The heat sink member 102 includes a unitary band or finless ring member 103. The finless ring member 103 is finless and joins the upper globe portion 104 and lower globe portion 106. An exterior surface 110 of the heat sink ring member 102 is finless, is disposed exterior of the lighting fixture 100, and is exposed to the air for optimal cooling. As illustrated in FIG. 3A, an inside surface 114 of the heatsink member 102 has predetermined surfaces 116 which allow selective positioning of the LEDs (not shown in FIG. 3A) to provide optimal performance.

Referring to FIG. 2, the lighting fixture 100 comprises components attached to and within the upper globe portion 104, the heat sink member 102, and the lower globe portion 106. As shown, the lower globe portion 106 mates with or connects to a lower fitter 122. In this embodiment, a conduit 124 is disposed within and extends through the lower globe portion 106 and heat sink member 102. A fitting conduit 126 may attach to the conduit 124 to receive a lid 130 disposed to the fitting conduit 126.

In this embodiment, first and second power supply brackets 132,134 house a power supply 136 and are disposed on the lid 130. It is to be understood that the power supply may be powered by any suitable power source, for example, by way of power wires (not shown) that may be disposed through the conduit 124. Moreover, a shortening cap 140 may be attached to the fitting conduit 126. As shown, an upper fitter 142 is disposed on the upper globe portion 104.

As shown, in this example, the heat sink member 102 is formed of a first material or a selected thermally conductive material such as cast aluminum and is either painted or anodized to protect the heat sink member 102 from corrosion. The thermally conductive material may be comprised of aluminum, aluminum alloy, iron, iron alloy or any other suitable material without departing from the spirit or scope of the present disclosure. The heat sink member 102 also can be formed of copper or other metal.

In this embodiment, the upper globe portion 104 and lower globe portion 106 are formed of a transparent or substantially transparent light transmitting material such as an acrylic or similar material. In this context, the term "substantially" is known to those skilled in the art. Alternatively in this context, the term "substantially" may be read to mean sufficiently such that performance of the lighting fixture from the perspective of one of ordinary skill in the art is the same as if the light transmitting material were transparent.

In one example, the upper globe portion 104 and lower globe portion 106 may be implemented with an A.L.P. LexaLite Model 424 top and a LexaLite Model 424, manufactured and sold by A.L.P. Lighting & Ceiling Products, Inc. of Niles, Ill.

In some aspects of the present disclosure, the upper globe portion or the lower globe portion may be formed from translucent material, which may be understood as material that transmits more than 5% of incident electromagnetic waves in the visible range (380 nm to 800 nm), including all values and ranges from 5% to 100% (399 nm to 800 nm), such as 50% to 99% (about 570 nm to about 756 nm), with or without (in the case of transparent material) diffusion of the light through the material.

Figure 3B:
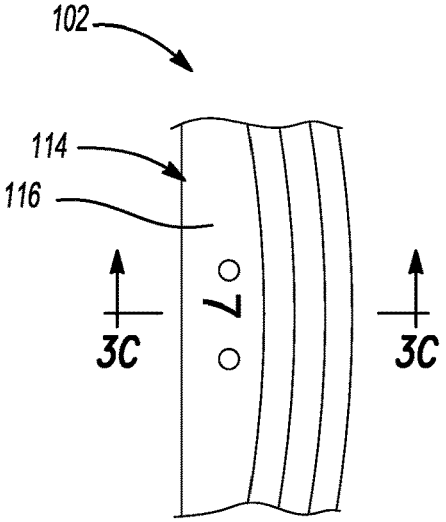
FIG. 3B is an enlarged view of circle 3B depicting the heat sink member in FIG. 3A according to one embodiment.
Figure 3C:
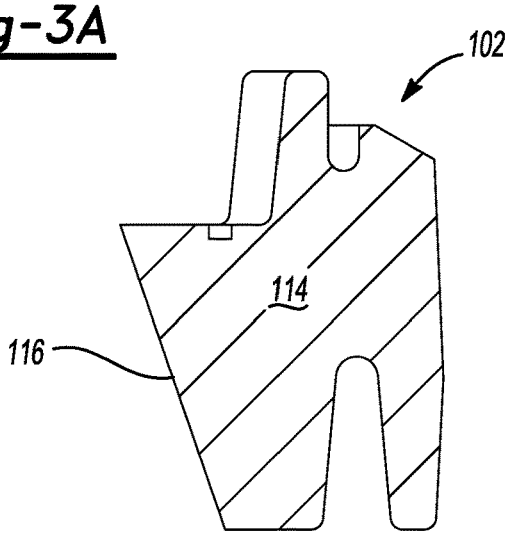
FIG. 3C is a cross-sectional view of the heat sink member taken along lines 3C-3C in accordance with one embodiment of the present disclosure.

Referring now to FIGS. 3A-3C, there is shown the finless heat sink member 102 of the lighting fixture 100 in accordance with the preferred embodiment. In FIGS. 3A-3C, the heat sink member 102 is shown separately from the lighting fixture 100. As shown, the inside surface 114 includes a plurality of mating surface portions 116 having a flat mating face configured for mating engagement with a respective light source board (see FIG. 4) and for selectively positioning of the light source boards. In this embodiment, the heat sink member comprises a first material having a volume V defined by:

$$V=(Q*(\lambda*2))/\Delta T.$$

In this embodiment, Q is a heat source power, λ is a thermal conductivity of the first material, and ΔT is a difference in temperature between a maximum thermal threshold temperature for a light-emitting diode and a maximum ambient temperature. In one example, the volume V may be determined based on the maximum thermal threshold temperature for an LED.

Thus, for example, for aluminum as the first material, where Q is 85 watts (W), λ is 205 W/m K, and maximum ambient temperature is 32° C., and where maximum thermal threshold is desired to be 80° C., $$V=(85\text{ watts}*(205\text{ W/m K}*2))/(80^\circ\text{ C.}-32^\circ\text{ C.})$$

$$V=(85*410.0)/(48)$$

$$V=726.04\text{ cm}^3$$

Figure 4:
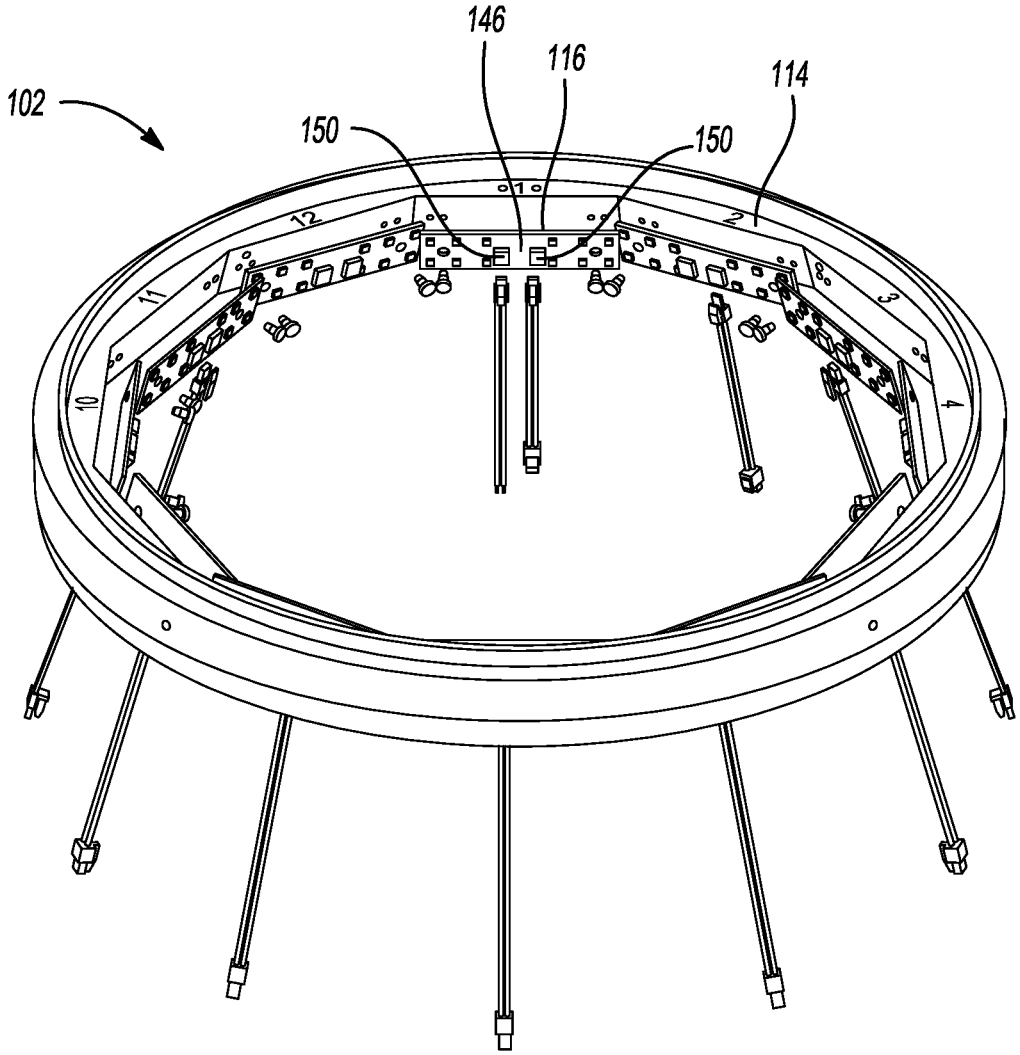
FIG. 4 is a perspective view of heat sink member in FIG. 1 according to an exemplary embodiment.

In FIG. 4, there is shown a plurality of light source boards generally designated by the reference character 146, each including a predefined number of light emitting diodes (LEDs) 150. The light source board 900 includes a metal core circuit board.

The ring shaped heat sink interior surface 114 has a plurality of mating surfaces 116, for example, twelve (12) mating interior surfaces 116 shown in FIG. 3A. Referring also to FIGS. 3A and 4, each mating surface 116 or side 116 being canted downwardly, for example, at an angle of about 22 degrees. This angle may result in an output of an LED 902 having a typical FWHM beam of between 90 and 140 degrees has its maximum candela running through a point on the centerline of the globe approximately 2.8" below the upper flange of a model which may be the design light center for the a particular model when using a light source. In this example, each of the 12-sided interior mating surfaces 116 may be, for example, 3.65" long and 1.125" high. Each side 116 has a flat mating face for mounting of the respective LED boards 146.

It is understood that the interior mating surfaces may be 7-sided to 12-sided without departing from the spirit or scope of the present disclosure. It is also to be understood that each mating surface 116 may be canted downwardly at an angle between about 15 degrees and about 30 degrees without departing from the spirit or scope of the present disclosure.

In this example, each of the LED boards may include the metal core circuit board and 12 Nichia 757G LEDs driven at 88 mA each, for a total of 144 LEDs totaling 85 watts. The fixture efficacy or lumens per watt for the lighting fixture with these LEDs may be greater than 80 lumens per watt.

The finless ring-shaped heat sink member 102 may be suited for dissipating at least 85 watts of heat in an ambient temperature of 25 degrees C., and resulting in a maximum case temperature of 80 degrees C. on the above referenced boards.

While the present invention has been described with reference to the details of the embodiments of the invention shown in the drawing, these details are not intended to limit the scope of the invention as claimed in the appended claims.

What is claimed is:

1. A lighting fixture comprising:

an upper globe portion and a lower globe portion formed of a substantially transparent light transmitting material for emitting light; and a unitary ring heat sink member including an outside surface and an inside surface, the inside surface including a plurality of mating surface portions having a flat mating face configured for mating engagement with a respective light source board and for selectively positioning of the light source boards, the heat sink member comprising a first material having a volume V defined by:

$$V=(Q*(\lambda*2))/\Delta T,$$

wherein Q is a heat source power, λ is a thermal conductivity of the first material, and ΔT is a difference in temperature between a maximum thermal threshold temperature for a light-emitting diode and a maximum ambient temperature.

2. The lighting fixture of claim 1 wherein the first material comprises one of aluminum, aluminum alloy, iron, and iron alloy.

3. The lighting fixture of claim 1 wherein the plurality of mating surface portions is between 7 and 12 mating surface portions.

4. The lighting fixture of claim 1 wherein the light-emitting diode is disposed on the light source board.

5. The lighting fixture of claim 1 wherein each flat mating face is formed canted downwardly at an angle between about 15 degrees and about 30 degrees.

6. The lighting fixture of claim 1 wherein each flat mating face is formed canted downwardly at an angle of about 22 degrees.

7. The lighting fixture of claim 1 wherein the one of the upper globe and the lower globe comprises a translucent material able to transmit more than about 5% of incident electromagnetic waves in visible range.

8. A lighting fixture comprising:

an upper globe portion and a lower globe portion formed of a substantially transparent light transmitting material for emitting light;

a unitary ring heat sink member comprising an outside surface and an inside surface, the outside surface being disposed exterior of the lighting fixture, the inside surface being disposed inside of the lighting fixture, the inside surface including a plurality of mating surface portions having a flat mating face configured for mating engagement with a respective light source board and for selectively positioning of the light source boards, wherein the heat sink member joins the upper globe portion and the lower globe portion of the lighting fixture, the heat sink member comprising a first material having a volume V defined by:

$$V=(Q*(\lambda*2))/\Delta T,$$

wherein Q is a heat source power, λ is a thermal conductivity of the first material, and ΔT is a difference in temperature between a maximum thermal threshold temperature for a light-emitting diode and a maximum ambient temperature.

9. The lighting fixture of claim 1 wherein the first material comprises one of aluminum, aluminum alloy, iron, and iron alloy.

10. The lighting fixture of claim 1 wherein the plurality of mating surface portions is between 7 and 12 mating surface portions.

11. The lighting fixture of claim 1 wherein the light-emitting diode is disposed on the light source board.

12. The lighting fixture of claim 1 wherein each flat mating face is formed canted downwardly at an angle between about 15 degrees and about 30 degrees.

13. The lighting fixture of claim 1 wherein each flat mating face is formed canted downwardly at an angle of about 22 degrees.

14. The lighting fixture of claim 1 wherein the one of the upper globe and the lower globe comprises a translucent material able to transmit more than about 5% of incident electromagnetic waves in visible range.

15. A lighting fixture comprising:

an upper globe portion and a lower globe portion formed of a substantially transparent light transmitting material for emitting light; and a unitary ring heat sink member including an outside surface and an inside surface, the inside surface including a plurality of mating surface portions having a flat mating face configured for mating engagement with a respective light source board and for selectively positioning of the light source boards, the heat sink member comprising a first material having a volume V defined by:

$$V=(Q*(\lambda*2))/\Delta T,$$

wherein Q is a heat source power, λ is a thermal conductivity of the first material, and ΔT is a difference in temperature between a maximum thermal threshold temperature for a light-emitting diode and a maximum ambient temperature, wherein each flat mating face is formed canted downwardly at an angle between about 15 degrees and about 30 degrees.

16. The lighting fixture of claim 15 wherein the first material comprises one of aluminum, aluminum alloy, iron, and iron alloy.

17. The lighting fixture of claim 15 wherein the plurality of mating surface portions is between 7 and 12 mating surface portions.

18. The lighting fixture of claim 15 wherein the light-emitting diode is disposed on the light source board.

19. The lighting fixture of claim 15 wherein each flat mating face is formed canted downwardly at an angle of about 22 degrees.

20. The lighting fixture of claim 15 wherein the one of the upper globe and the lower globe comprises a translucent material able to transmit more than about 5% of incident electromagnetic waves in visible range.

* * * * *